US010608358B2

(12) United States Patent
Hou et al.

(10) Patent No.: US 10,608,358 B2
(45) Date of Patent: Mar. 31, 2020

(54) ELECTRICAL ADAPTOR AND CABLE CONNECTOR USING THE SAME

(71) Applicant: Advanced Connectek Inc., New Taipei (TW)

(72) Inventors: Pin-Yuan Hou, New Taipei (TW); Yu-Lun Tsai, New Taipei (TW); Hsu-Fen Wang, New Taipei (TW); Yu-Chai Yeh, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/198,886

(22) Filed: Nov. 23, 2018

(65) Prior Publication Data

US 2019/0165507 A1 May 30, 2019

(30) Foreign Application Priority Data

Nov. 24, 2017 (TW) ..... 106217493 U

(51) Int. Cl.

| | |
|---|---|
| ***H01R 12/77*** | (2011.01) |
| ***H01R 31/06*** | (2006.01) |
| ***H01R 13/506*** | (2006.01) |
| ***H01R 24/60*** | (2011.01) |
| ***H01R 12/71*** | (2011.01) |
| *H01R 13/6585* | (2011.01) |
| *H01R 107/00* | (2006.01) |

(52) U.S. Cl.

CPC ..... *H01R 12/775* (2013.01); *H01R 12/714* (2013.01); *H01R 12/771* (2013.01); *H01R 13/506* (2013.01); *H01R 24/60* (2013.01); *H01R 31/06* (2013.01); *H01R 13/6585* (2013.01); *H01R 2107/00* (2013.01)

(58) Field of Classification Search

CPC ..... H01R 31/06

See application file for complete search history.

(56) References Cited

U.S. PATENT DOCUMENTS

| | | | | |
|---|---|---|---|---|
| 7,204,723 | B2 * | 4/2007 | Sun | H01R 13/514 439/701 |
| 7,255,567 | B1 * | 8/2007 | Liao | H01R 31/06 439/11 |
| 7,416,413 | B2 * | 8/2008 | Liao | H01R 31/06 439/11 |
| 9,312,651 | B2 * | 4/2016 | Hsiang | H01R 13/6582 |
| 9,859,660 | B2 * | 1/2018 | Lee | H01R 13/648 |
| 10,256,585 | B1 * | 4/2019 | Wierenga | H01R 31/06 |
| 10,320,136 | B2 * | 6/2019 | Michelmann | H01R 31/06 |
| 2011/0136387 | A1 * | 6/2011 | Matsuura | H01R 31/06 439/636 |

(Continued)

*Primary Examiner* — Ross N Gushi

(74) *Attorney, Agent, or Firm* — JCIPRNET

(57) ABSTRACT

A cable connector including a first base, a second base, a plurality of first terminals disposed in the first base with a plurality of first tail segments exposed out of the first base, a plurality of second terminals disposed in the second base with a plurality of second segments exposed out of the second base, and a plurality of cables electrically connecting the second terminals is provided. The first and the second bases are detachably assembled, such that the first tail segments are detachably connected to the second contact segments in structural contact to electrically connect the first terminals and the second terminals. An electrical adaptor is also disclosed.

32 Claims, 13 Drawing Sheets

(56) References Cited

U.S. PATENT DOCUMENTS

| | | | | |
|---|---|---|---|---|
| 2014/0273613 | A1* | 9/2014 | McSweyn | H01R 27/00 439/518 |
| 2015/0214684 | A1* | 7/2015 | Chen | H01R 35/04 439/217 |
| 2015/0288118 | A1* | 10/2015 | Michelmann | H01R 13/502 439/38 |
| 2015/0357757 | A1* | 12/2015 | Wu | H01R 13/639 439/300 |
| 2016/0211609 | A1* | 7/2016 | Sorias | H01R 13/6205 |

* cited by examiner

ELECTRICAL ADAPTOR AND CABLE CONNECTOR USING THE SAME

CROSS-REFERENCE TO RELATED APPLICATION

This application claims the priority benefit of Taiwan patent application serial no. 106217493, filed on Nov. 24, 2017. The entirety of the above-mentioned patent application is hereby incorporated by reference herein and made a part of the specification.

BACKGROUND OF THE INVENTION

Field of the Invention

The invention relates to an electrical adaptor and a cable connector using the same.

Description of Related Art

In recent years, along with people's growing demand on transmission rate and storage capacity, a transmission rate of a universal serial bus (USB) has been developed to a USB3.1 super speed+ specification. Particularly, a USB Type-C of a new specification may provide a maximum transmission rate of 10 Gbps, and has a faster transmission rate in case of transmitting a large-capacity file, so as to effectively shorten a transmission time.

Generally, a plug and a socket of an existing USB connector all include a flat terminal and an elastic terminal, though improper operations of a user may cause a damage of the elastic terminal and abrasion of other peripheral structures, in this case, a corresponding maintenance method is only to replace a damaged part after de-soldering or destructively disassembling a structure thereof, and then solder and assemble the structure again. Therefore, such process is time-consuming and labor-costing, and results in a high maintenance cost. Meanwhile, due to a poor design, the existing connector generally has a lower shielding efficiency for a radio frequency interference, which has an impact on high frequency signal transmission of the USB Type-C.

Further, regarding today's USB Type-C specification, the number of terminals is obviously higher than a past specification, meanwhile, a size of a corresponding soldering circuit board is designed towards a trend of light and slim, which results in a limited soldering space, so that the above structure destruction and re-assembling is hard to be implemented, and regardless of manual soldering or other types of soldering, wire trimming or wire soldering on the circuit board becomes very difficult.

Therefore, how to provide a simple connector structure to effectively decrease a time, a labor-cost and a manufacturing cost of a rework process under a premise of maintaining an existing operation mode, and improve the shielding efficiency of the connector structure for the radio frequency interference is an important issue to be resolved by related technicians.

SUMMARY OF THE INVENTION

The invention is directed to a cable connector, wherein an electrical adaptor and a cable assembly are detachably assembled to each other, such that a performance thereof is maintained, and also a disassembling and a replacing procedures are easy to be implemented.

The invention provides a cable connector including a first base, a plurality of first terminals, a second base, a plurality of second terminals and a plurality of cables. The first terminals are respectively disposed in the first base, and each of the first terminals has a first tail segment exposed out of the first base. The second terminals are respectively disposed in the second base, and each of the second terminals has a second contact segment exposed out of the second base, and the cables are electrically connected to tail ends of the second terminals. The first base and the second base are detachably assembled with each other, and the first tail segments are respectively and detachably connected to at least a part of the second contact segments in structural contact, such that the second contact segments of the second terminals respectively abut against the first tail segments of the first terminals and then the first terminals are respectively electrically connected to the second terminals, and the cable connector is electrically connected to an external device through a plurality of first contact segments of the first terminals, wherein the first tail segments and the first contact segments are two opposite ends of the first terminals.

The invention provides an electrical adaptor including a first base and a plurality of first terminals, wherein the first terminals are disposed in the first base. The electrical adaptor is detachably butted with a second base and a plurality of second terminals of a cable assembly through the first base and the first terminals, such that a first tail segment of each of the first terminals is detachably leaned against a second contact segment of each of the second terminals. The first tail segments are disposed in a plurality of guide slots on the first substrate and are located in a same plane, and each of the first terminals further has a first contact segment opposite to the first tail segment, and the first contact segments respectively belong to two planes different to and parallel with each other, wherein the cable assembly is electrically connected to an external device through the first contact segments of the electrical adaptor.

According to the above description, the cable connector is composed of a cable assembly and an electrical adaptor that are detachable from each other, so that besides a performance of a connector is maintained, disassembling and replacing procedures are easy to be implemented. Namely, during a rework process of the detachable structure, the electrical adaptor having a higher chance of abrasion (loss) may be easily disassembled for replacement, and a user is unnecessary to destructively disassemble the whole structure, so that a labor-cost, a time cost and a material cost of the rework process are saved, which avails improving applicability of the cable connector.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
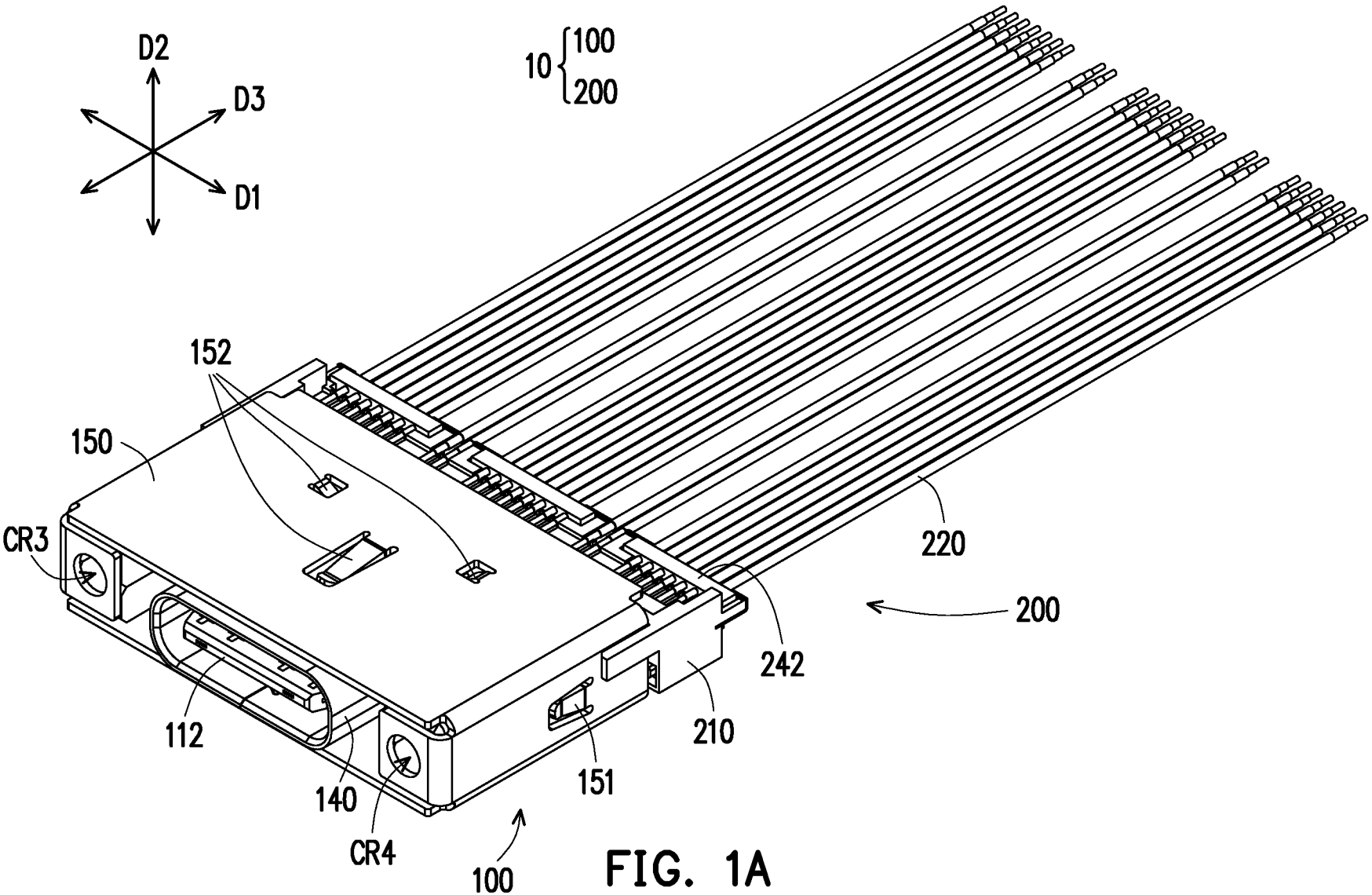
FIG. 1A is a schematic diagram of a cable connector according to an embodiment of the invention.
Figure 1B:
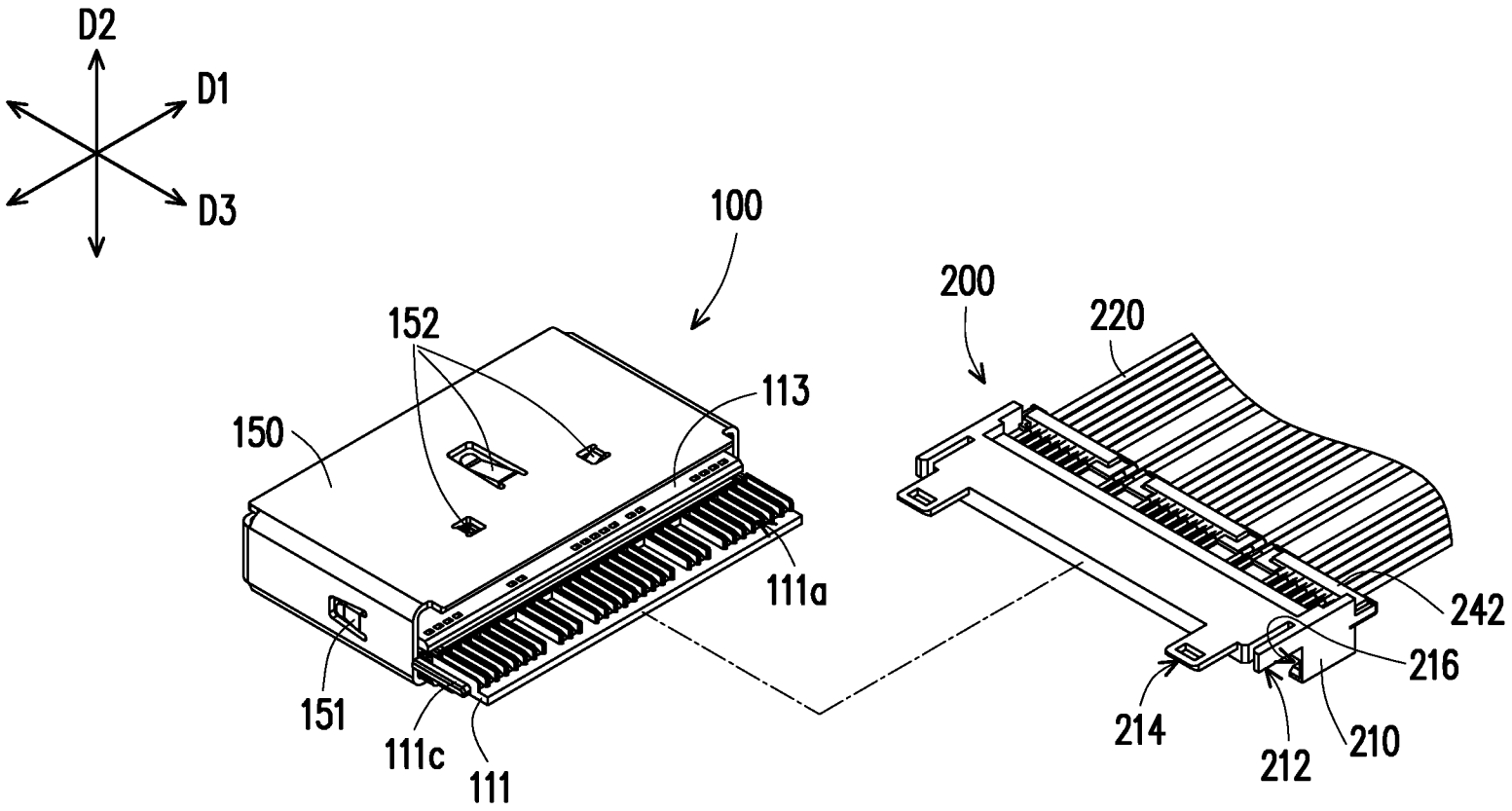
FIG. 1B is a schematic diagram of assembling the cable connector of FIG. 1A.
Figure 1C:
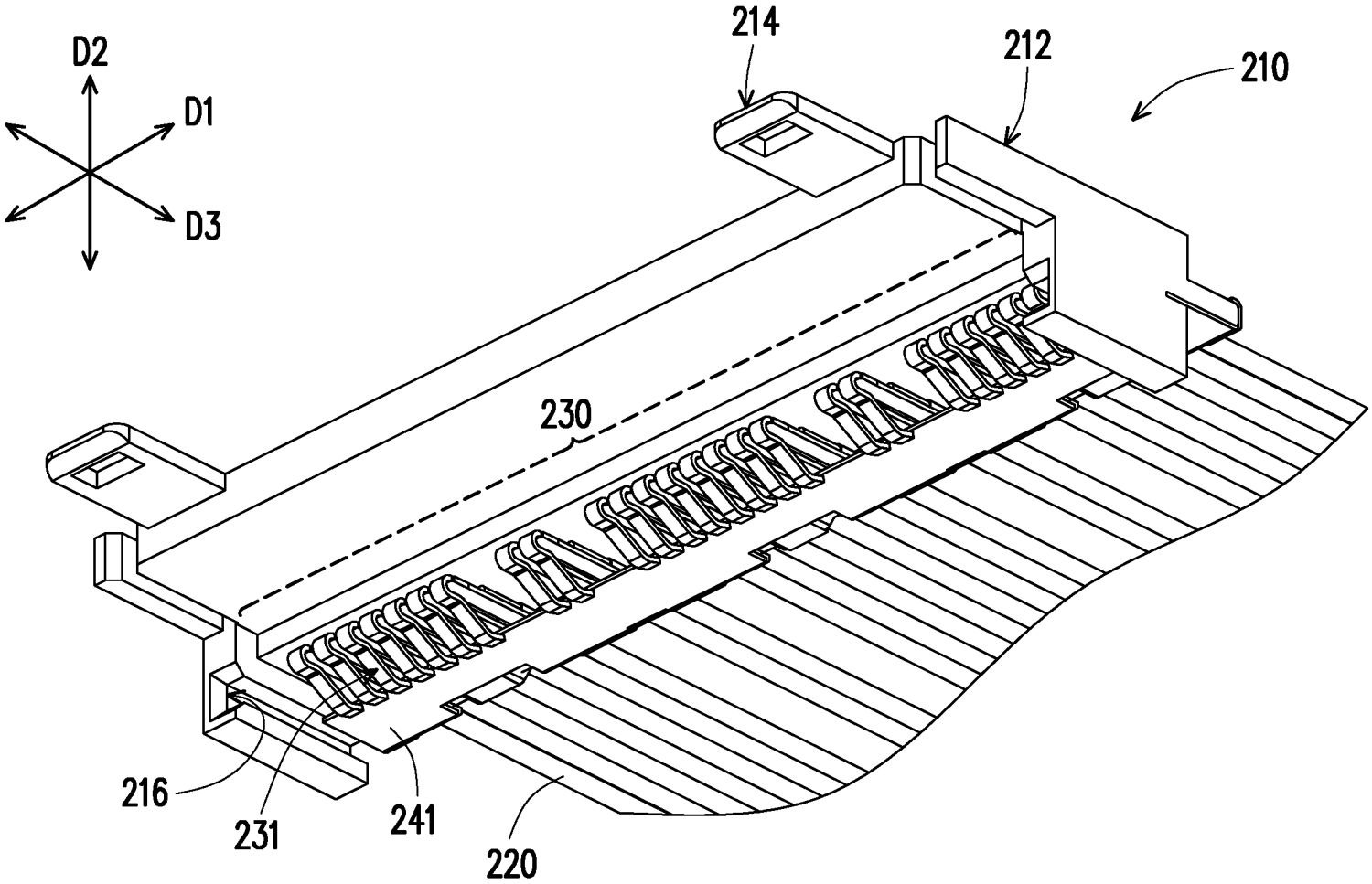
FIG. 1C is a partial schematic diagram of a cable assembly of FIG. 1B.
Figure 1D:
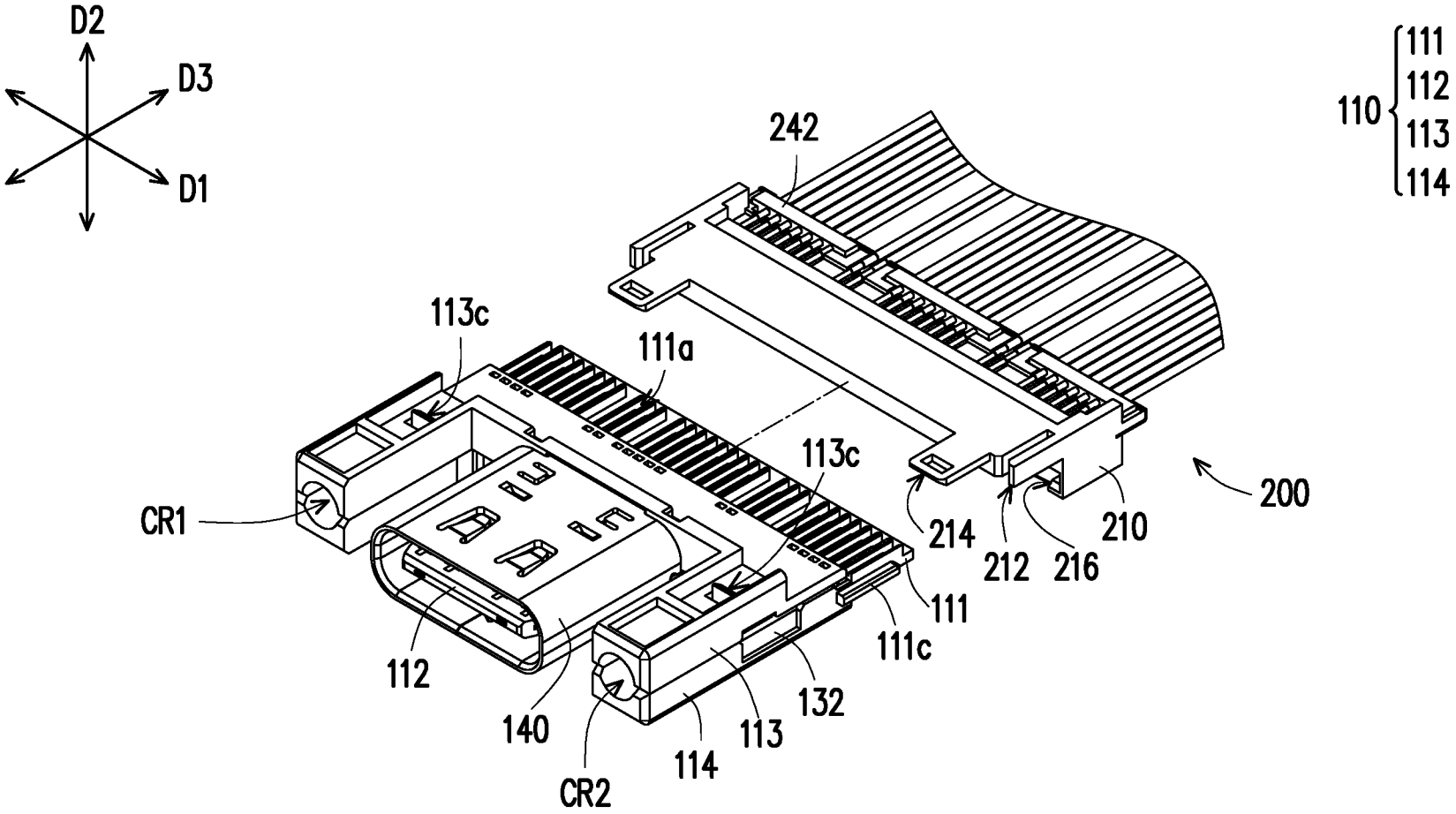
FIG. 1D is a schematic diagram of assembling the cable assembly and an electrical adaptor.

FIG. 1A is a schematic diagram of a cable connector according to an embodiment of the invention. FIG. 1B is a schematic diagram of assembling the cable connector of FIG. 1A. FIG. 1C is a partial schematic diagram of a cable assembly of FIG. 1B. FIG. 1D is a schematic diagram of assembling the cable assembly and an electrical adaptor. A first axis D1, a second axis D2 and a third axis D3 orthogonal with each other are provided to serve as reference coordinates for subsequent component description. Referring to FIG. 1A to FIG. 1D, in the embodiment, the cable connector 10 includes an electrical adaptor 100 and a cable assembly 200 that are detachable from each other, where the cable assembly 200 is adapted to be connected to a circuit board in a computer host, and is adapted to electrically connect an external device (not shown) through the electrical adaptor 100. As describe above, since the electrical adaptor 100 with a pluggable structure is easy to be damaged, in the embodiment, the electrical adaptor 100 is designed into a detachable structure to facilitate maintenance and replacement.

Figure 2A:
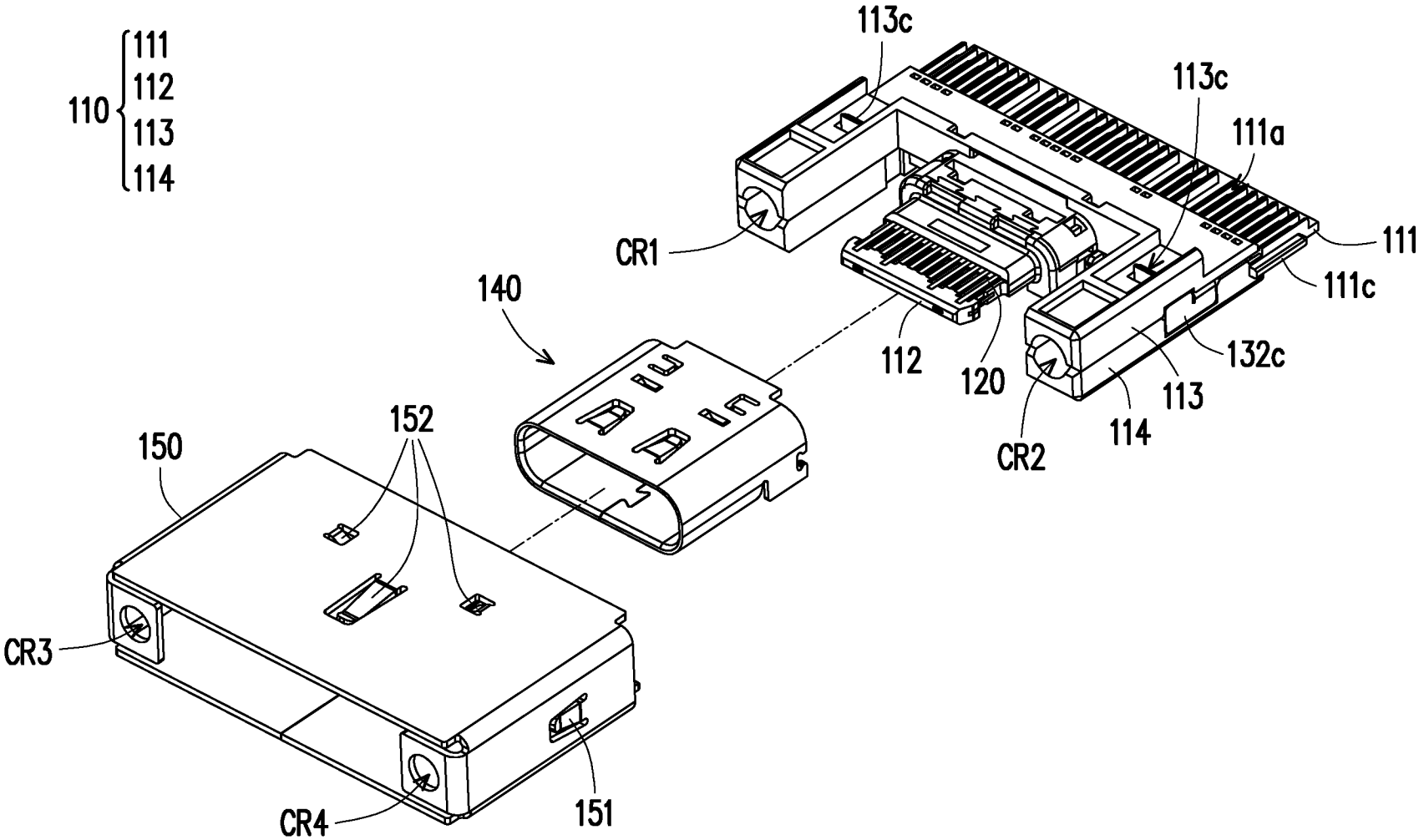
FIG. 2A and FIG. 2B are component exploded views of the electrical adaptor in different degrees.
Figure 2B:
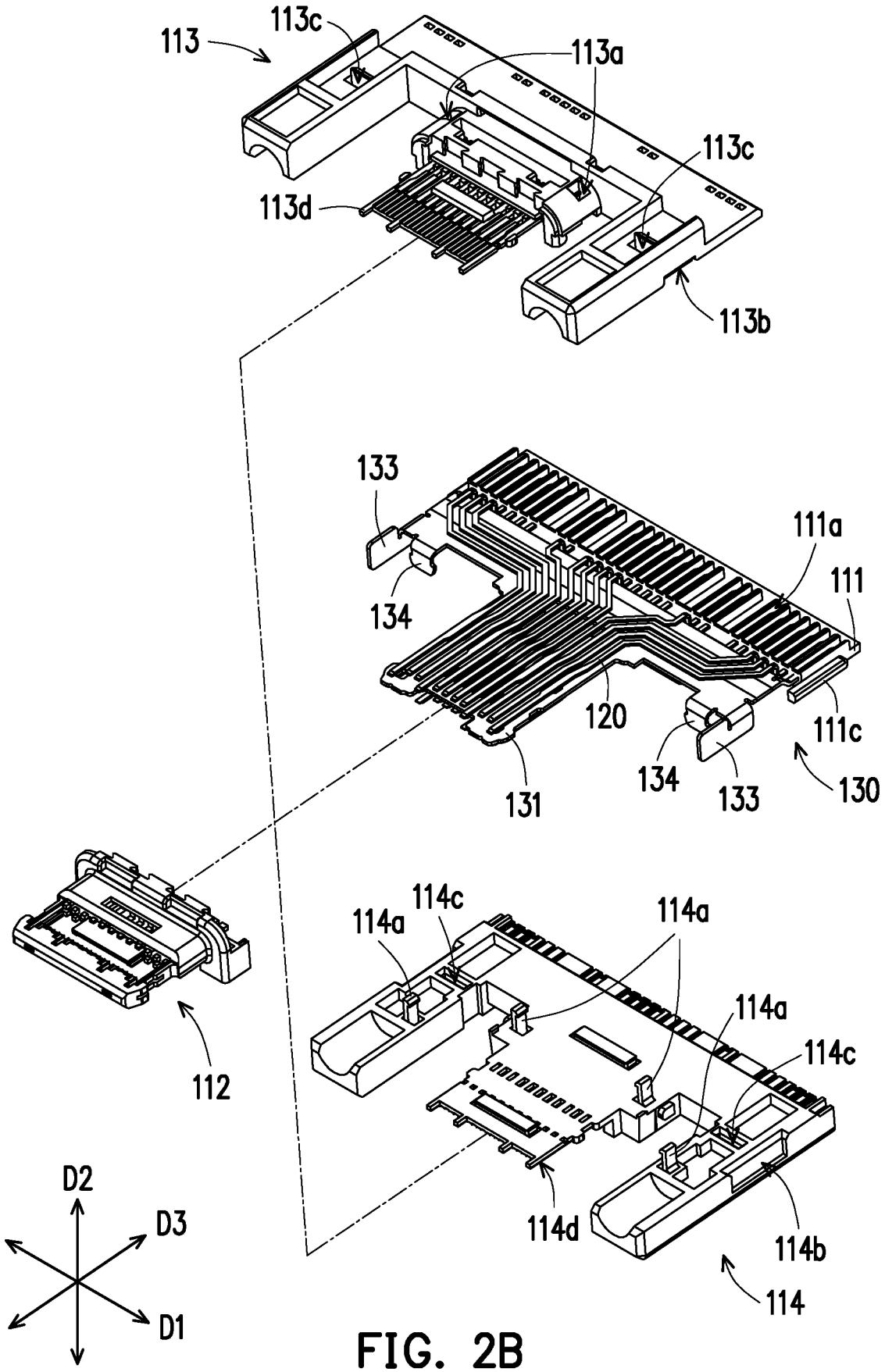

FIG. 2A and FIG. 2B are component exploded views of the electrical adaptor in different degrees. FIG. 2D is an exploded view of first terminals and a shielding plate of FIG. 2B. Referring to FIG. 2A, FIG. 2B and FIG. 2D, the electrical adaptor 100 includes a first base 110 and a plurality of first terminals 120, where the first terminals 120 are respectively disposed in the first base 110, and have a plurality of first tail segments S1, S4 exposed out of the first base 110 and accommodated in a plurality of guide slots 111*a* of the first base 110. As shown in FIG. 1C, the cable assembly 200 includes a second base 210 and a plurality of second terminals 230, where a tail end of each of the second terminals 230 is electrically connected to a cable 220, and a second contact segment 231 of each of the second terminals 230 protrudes below the second base 210. In this way, in a butting process shown in FIG. 1B or FIG. 1D, the second contact segments 231 of the second terminals 230 may be moved in along the guide slots 111*a* for structurally leaning against the first tail segments S1, S4 of the first terminals 120, such that the cables 220, the second terminals 230, the first terminals 120 are electrically connected, and the cable connector 10 may normally operate. Namely, each of the first terminals 120 further has first contact segments S3, S6 (shown in FIG. 2D) opposite to the aforementioned first tail segments S1, S4 for electrically connecting the external device (not shown), so that regarding the assembled cable connector 10, the cable assembly 200 may be electrically connected to the external device through the electrical adaptor 100.

Referring to FIG. 1C and FIG. 2D, in the embodiment, the second contact segments 231 of the second terminals 230 are elastic structures, and the first tail segments S1, S4 of the first terminals 120 are pad structures and carried by the bottom of the guide slots 111*a*, so that when the first base 110 and the second base 210 are assembled through structural engaging and buckling, the guide slots 111*a* provide a guide effect to the second contact segments 231, such that besides correspondence between the terminals is ensured, a structural force produced due to the assembling process may force the elastic structures to deformably lean against the pad structures, so as to ensure a structural contact effect between the terminals. Through the elastic structures, when the first base 110 and the second base 210 are butted along the third axis D3, and after the second contact segments 231 of the second terminals 230 are moved into the corresponding guide slots 111*a* along the third axis D3, the second contact segments 231 may lean against the corresponding first tail segments S1, S4 along the second axis D2.

In another embodiment that is not shown, the aforementioned structures of the first terminals and the second terminals may be exchanged, i.e. the first tail segments of the first terminals are changed to the elastic structures, and the second contact segments of the second terminals are changed to the pad structures, by which the aforementioned structural butting effect is also achieved.

Figure 2C:
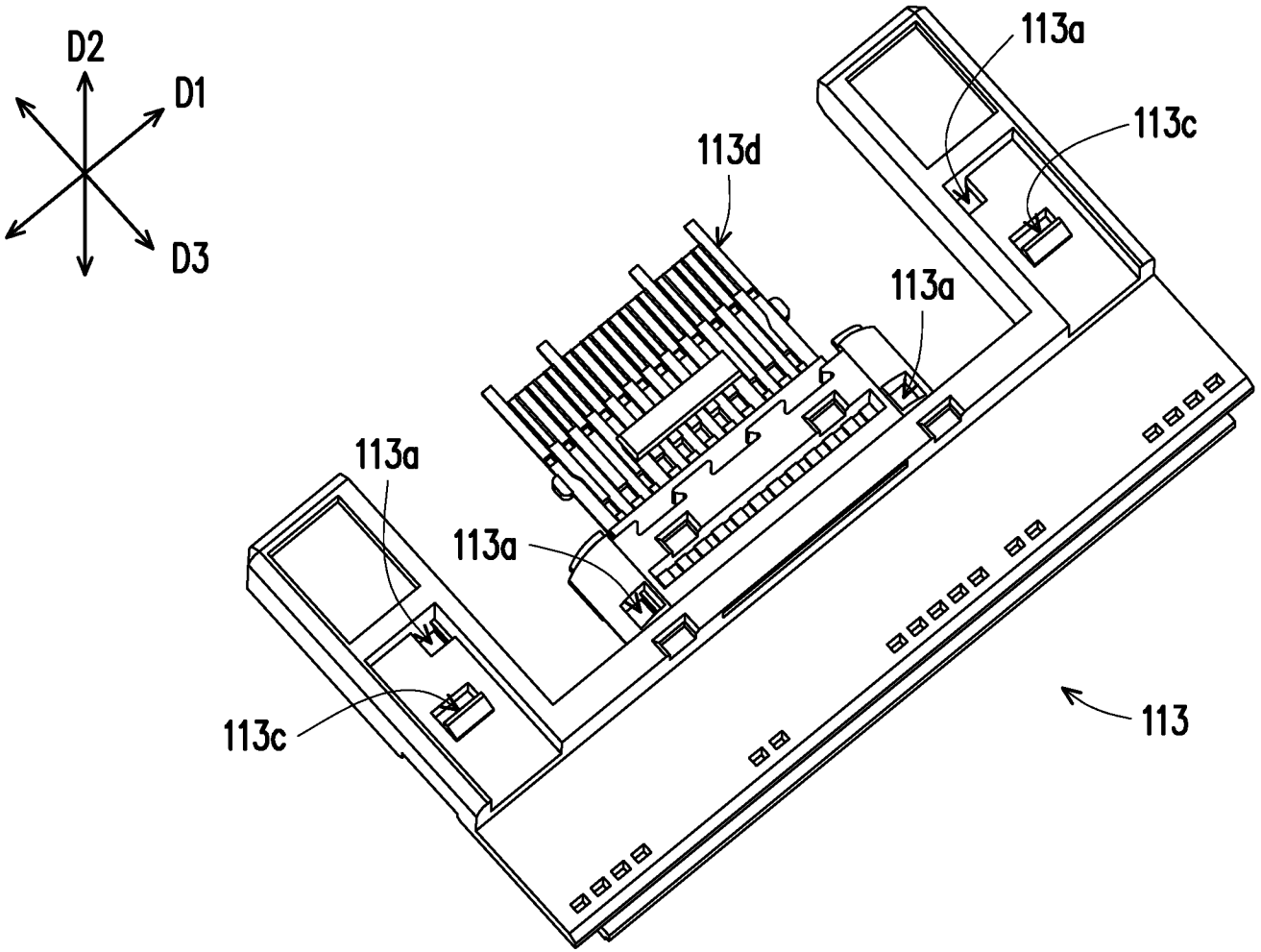
FIG. 2C is a schematic diagram of a third part of FIG. 2B.
Figure 2D:
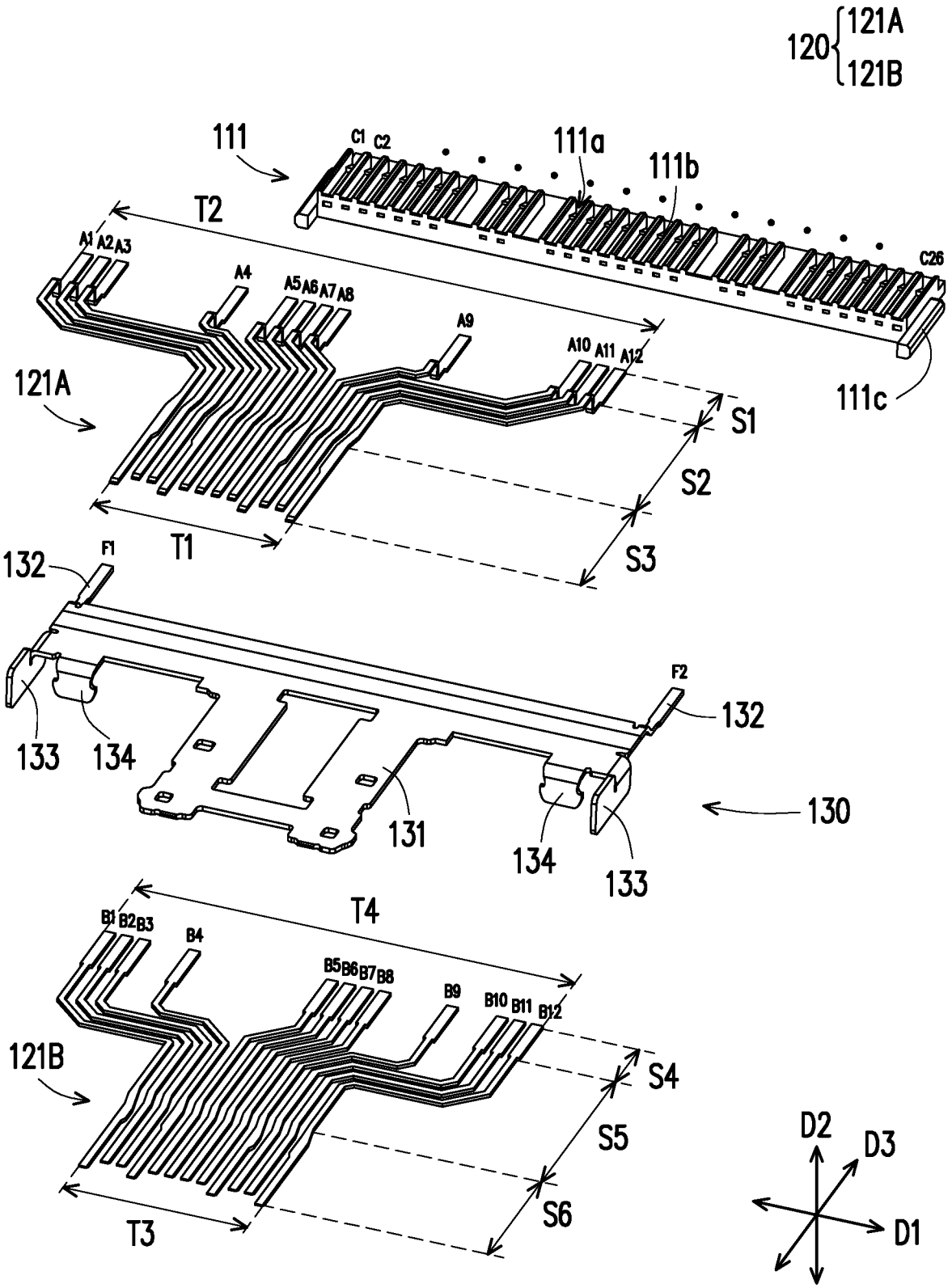
FIG. 2D is an exploded view of first terminals and a shielding plate of FIG. 2B.
Figure 2E:
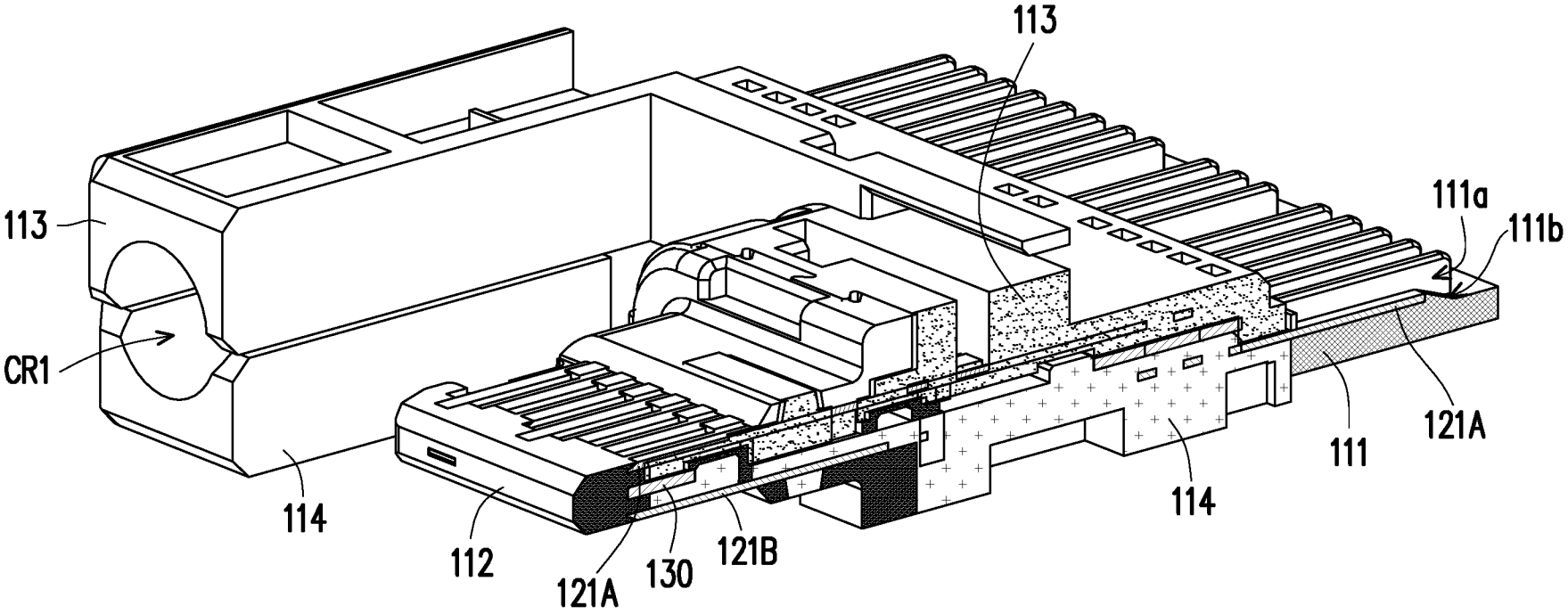
FIG. 2E is a partial cross-sectional view of a first base and the first terminals of FIG. 2A.

FIG. 2C is a schematic diagram of a third part of FIG. 2B. FIG. 2E is a partial cross-sectional view of the first base and the first terminals of FIG. 2A. referring to FIG. 2B to FIG. 2E, in the embodiment, the first base 110 includes a first part 111, a second part 112, a third part 113 and a fourth part 114, and the electrical adaptor 100 further includes a shielding plate 130, as shown in FIG. 2B and FIG. 2D, the first terminals 120, the shielding plate 130 and the first part 111 are substantially an integral structure, which is, for example, produced based on an insert molding technique, and after the third part 113 and the fourth part 114 are assembled to each other along the second axis D2 to clamp a part of the shielding plate 130 and the first terminals 120, the above parts are assembled with the second part 112, where the third part 113 has a tongue structure 113*d*, the shielding plate 130 has a tongue structure 131, the fourth part 114 has a tongue structure 114*d*, and the second part 112 substantially sleeves the first contact segments S3, S6 of the first terminals 120 and the tongue structures 113*d*, 131 and 114*d* to bond the aforementioned members. As shown in FIG. 2E, after the aforementioned members are bonded, the tongue structure 131 of the shielding plate 130 and the first contact segments S3, S6 are spaced by the tongue structure 113*d* of the third part 113 and the tongue structure 114*d* of the fourth part 114, so as to avoid an electrical connection between the shielding plate 130 and the first terminals 120. Now, the first part 111 is exposed out of the third part 113 and the fourth part 114 along the third axis D3. In this way, the shielding plate 130 may provide a shielding effect for signal transmission of the first contact segments S3, S6.

More importantly, the shielding plate 130 further has third terminals 132, and the third terminals 132 deviate from the tongue structure 131 and extend into the guide slots 111*a* of the first part 111. Namely, when the first base 110 is assembled to the second base 210, the third terminals 132 may be electrically connected to at least one of the second terminals 230 to achieve a common grounding effect. In other words, in the embodiment, an amount of the second terminals 230 is equal to a sum of an amount of the first terminals 120 and an amount of the third terminals 132.

Referring to FIG. 2D, in detail, the first terminals 120 of the embodiment belong to different groups (a first group 121A and a second group 121B) with an up and down configuration along the second axis D2 at the first contact segments S3, S6, and the tongue structure 131 of the shielding plate 130 is located between the aforementioned groups, namely, the first contact segments S3, S6 divided into the first group 121A and the second group 121B respectively belong to planes different to and parallel with each other (the planes are parallel to a plane formed by the first axis D1 and the third axis D3). Comparatively, after the first terminals 120 of different groups extend to the first tail segments S1, S4, they are adapted to the guide slots 111*a* of the first part 111 and located in a same plane with the guide slots 111*a* (the plane is parallel to the plane formed by the first axis D1 and the third axis D3), so as to lean against the second terminals 230 located on the same plane shown in FIG. 1C. Meanwhile, the third terminals 132 of the shielding plate 130 are also extended to and accommodated in the guide slots 111*a* and are in the same plane with the first tail segments S1, S4, which avails the second terminals 230 simultaneously butting the first terminals 120 and the third terminal 132.

The first part 111 further has stop points 111*b* located in the guide slots 111*a*, and the stop points 111*b* are used for stopping and positioning the first tail segments S1, S4 of the first terminals 120 and the third terminals 132 after injection molding.

In other words, the first terminals 120 has first connection segments S2, S5 connected between the first tail segments S1, S4 and the first contact segments S3, S6, and the first connection segments S2, S5 have bending structures to facilitate extending to a same plane from two planes different to and parallel with each other. Regarding the first terminals 120 of the second group 121B, the first contact segments S6, the first connection segments S5 and the first tail segments S4 are all located in a same plane, and regarding the first terminals 120 of the first group 121A, the first connection segments S2 thereof have bending structures, such that the first tail segments S1 may be located in a same plane with the first tail segments S4. As shown in FIG. 2A, since only the first part 111 is exposed out of the third part 113 and the fourth part 114, the bending structures of the first connection segments S2 substantially exist in the third part 113 (or/and the fourth part 114).

On the other hand, the first tail segments S1, S4 and the first contact segments S3, S6 are respectively arranged along the first axis D1, and arrangement lengths T2, T4 of the first tail segments S1, S4 along the first axis D1 is greater than arrangement lengths T1, T3 of the first contact segments S3, S6 along the first axis D1, where T1=T3<T4<T2.

Figure 4A:
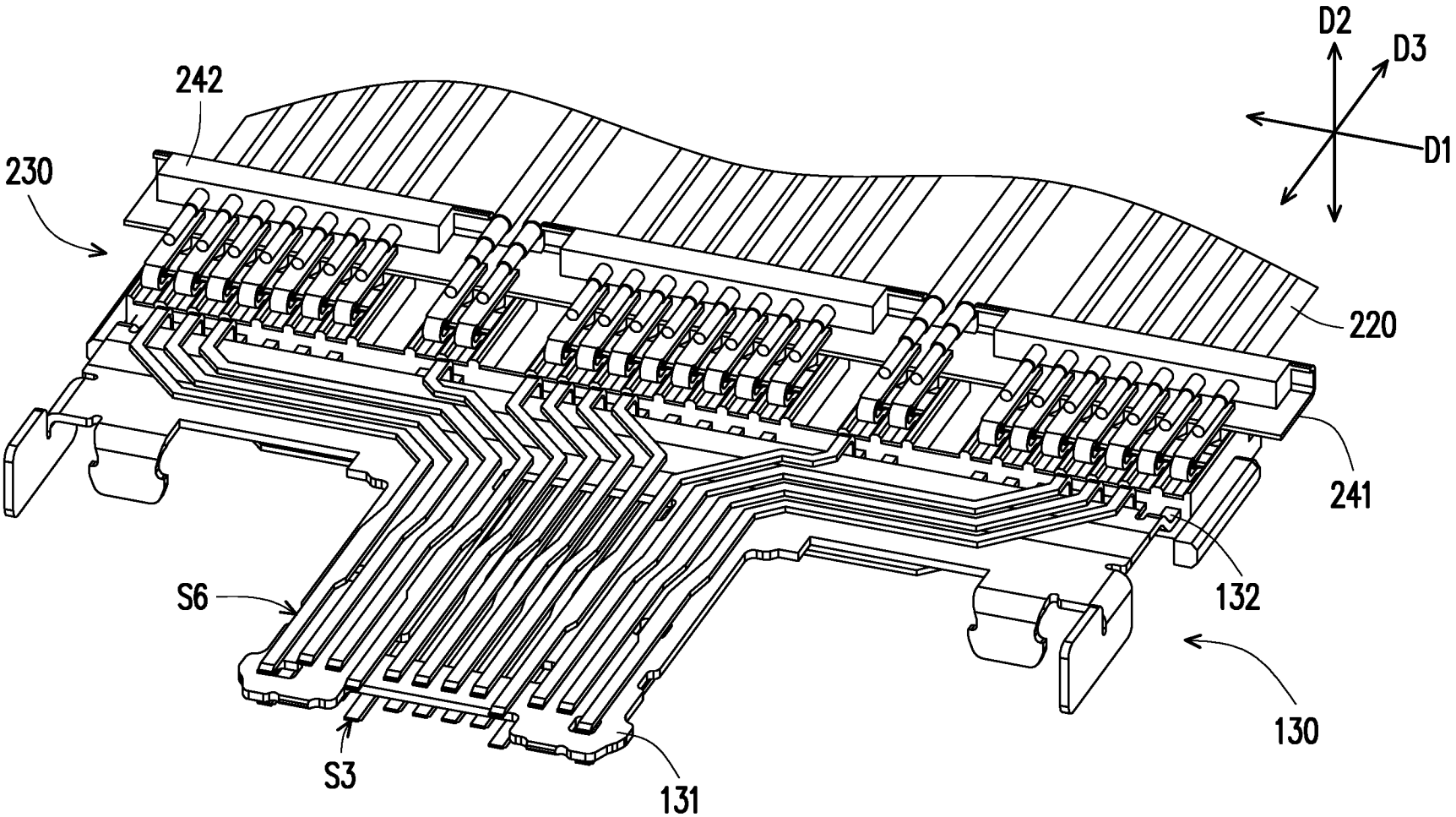
FIG. 4A to FIG. 4C respectively illustrate a part of the cable connector in different viewing angles.
Figure 4B:
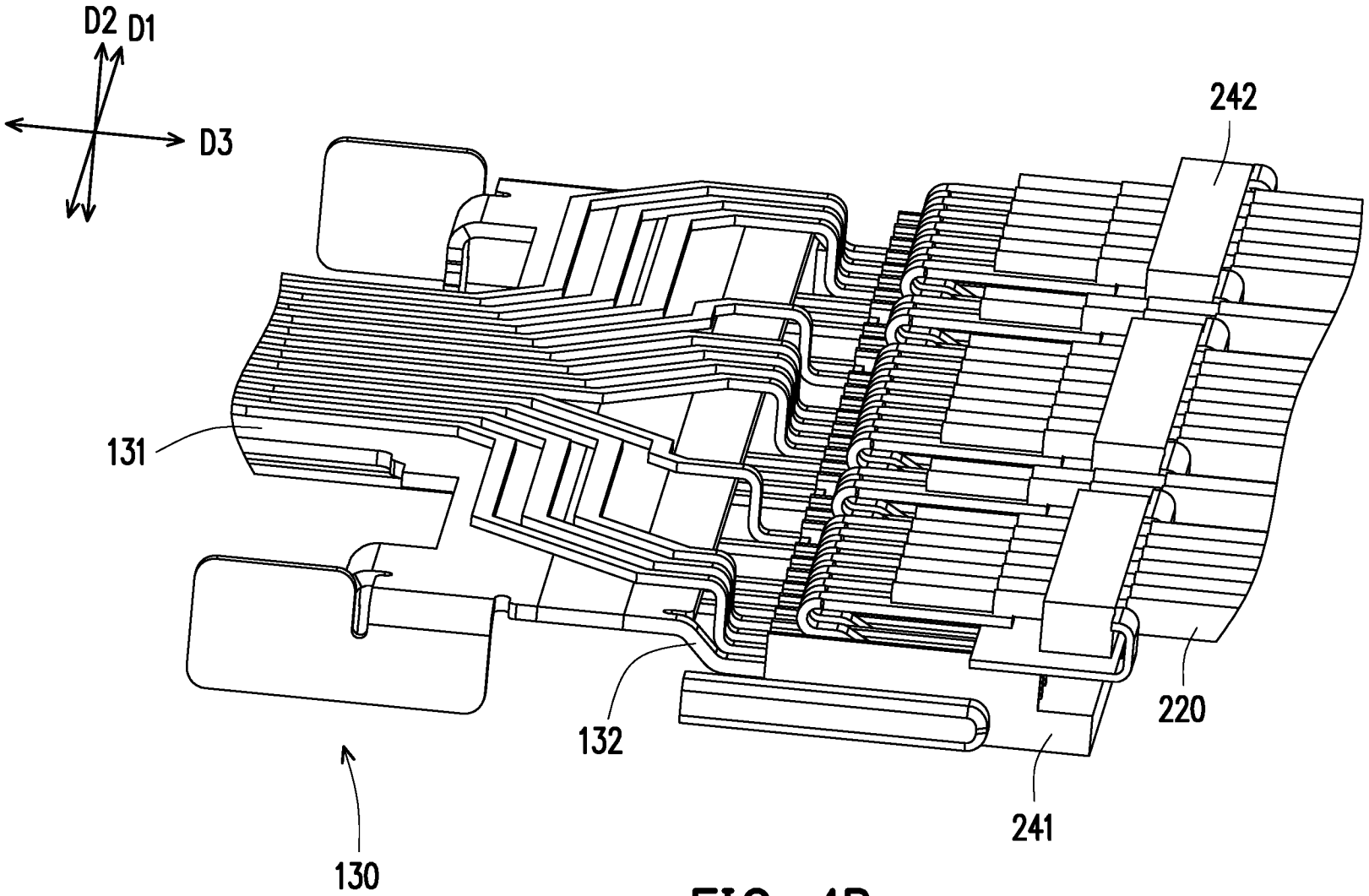
Figure 4C:
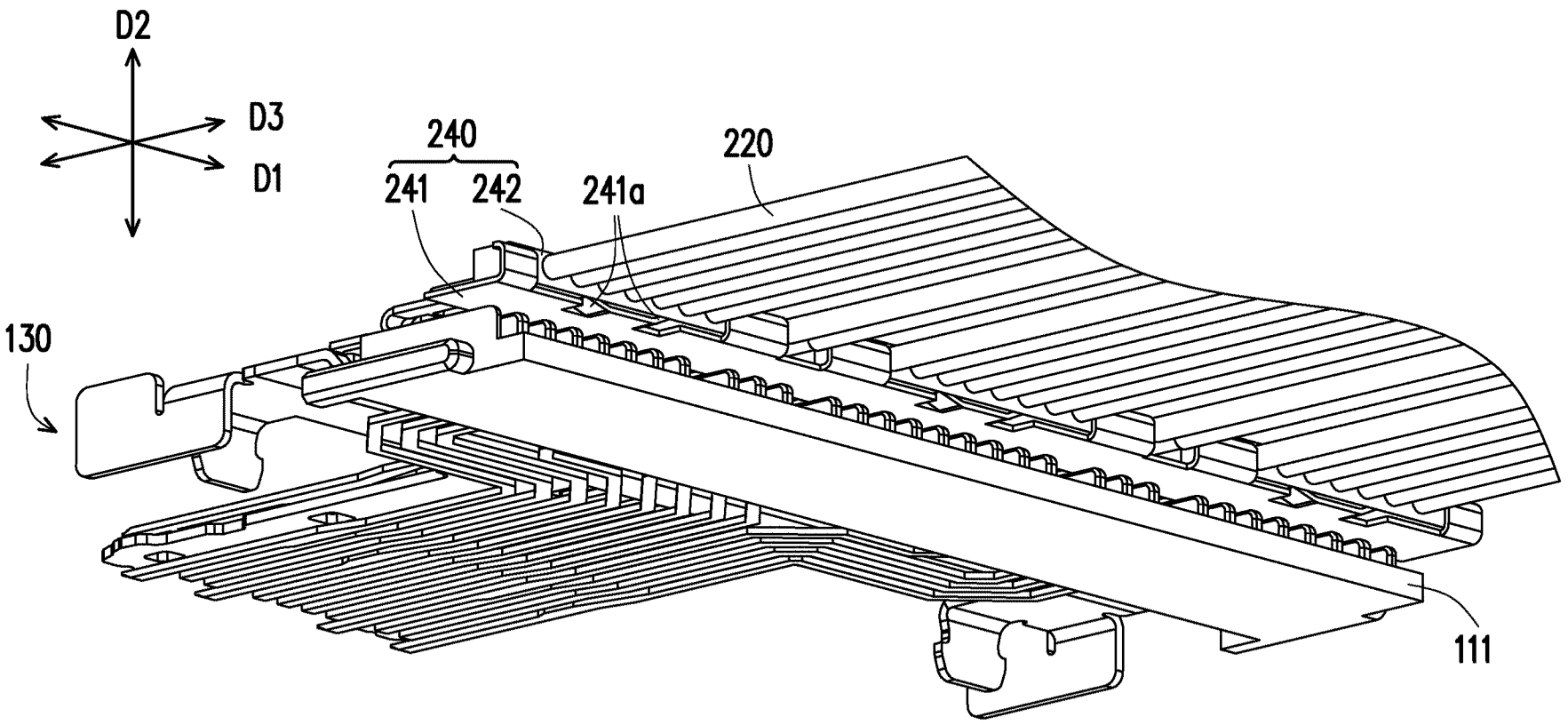

FIG. 4A to FIG. 4C respectively illustrate a part of the cable connector in different viewing angles. Referring to FIG. 4A to FIG. 4C, the first terminals 120 having the bending structures may be identified. Moreover, in FIG. 2D of the embodiment, the guide slots 111*a* are numbered as C1-C26, the first group 121A of the first terminals 120 are numbered as A1-A12, the second group 121B of the first terminals 120 are numbered as B1-B12, and the third terminals 132 are numbered as F1, F2. In this way, positions of the first terminals 120 and the third terminals 132 corresponding to the guide slots 111*a* are shown as follow:

| | | | | | | | | | | | | | | |
|---|---|---|---|---|---|---|---|---|---|---|---|---|---|---|
| C1 | C2 | C3 | C4 | C5 | C6 | C7 | C8 | C9 | C10 | C11 | C12 | C13 | C14 | C15 |
| F1 | A1 | A2 | A3 | B1 | B2 | B3 | B4 | A4 | A5 | A6 | A7 | A8 | B5 | B6 |
| C16 | C17 | C18 | C19 | C20 | C21 | C22 | C23 | C24 | C25 | C26 | | | | |
| B7 | B8 | A9 | B9 | B10 | B11 | B12 | A10 | A11 | A12 | F2 | | | | |

For example, the guide slot 111*a* of the referential number C1 is used for accommodating the third terminal 132 of the referential number F1, the guide slot 111*a* of the referential number C2 is used for accommodating the first terminal 120 of the referential number A1 of the first group 121A, . . . , etc., such that a pin corresponding relationship of the guide slots 111*a* and the first terminals 120 and the third terminals 132 is clearly known, where the positions of the third terminals 132 are substantially located at the first or last position of arranging positions of the first terminals 120. Further, the arranging positions of the first terminals 120 of the embodiment at the first tail segments S1, S4 are substantially located between a pair of the third terminals 132 of the shielding plate 130.

Referring to FIG. 2B and FIG. 2C, in the embodiment, the third part 113, the shielding plate 130 and the fourth part 114 respectively have corresponding structures adapted to be assembled with each other. In detail, the fourth part 114 has (four) hooks 114*a* for correspondingly hooking (four) hook holes 113*a* (identified from FIG. 2B and FIG. 2C) of the third part 113. The fourth part 114 has slots 114*c* to facilitate buckling arms 134 of the shielding plate 130 to buckle the slots 114*c*, and the third part 113 and the fourth part 114 respectively have recesses 113*b*, 114*b*. Comparatively, the shielding plate 130 further has side wings 133 located at two opposite sides of the tongue structure 131 along the first axis D1. After the third part 113 and the fourth part 114 are bonded, the recesses 113*b*, 114*b* form groove structures to accommodate the side wings 133 of the shielding plate 130, such that the side wings 133 are exposed out of the third part 113 and the fourth part 114.

Moreover, referring to FIG. 2A, the electrical adaptor 100 of the cable connector 10 of the embodiment further includes a first shielding case 150, which sleeves and wraps the second part 112, the third part 113 and the fourth part 114 of the first base 110 and the first terminals 120 disposed therein. The first shielding case 150 has elastic arms 151 located at side plates thereof, and when the first shielding case 150 sleeves the third part 113 and the fourth part 114, the elastic arms 151 may be structurally leaned against the aforementioned side wings 133. In this way, the shielding plate 130 and the first shielding case 150 has an electrical conduction effect, by which besides the two components are commonly grounded, a shielding effect is also improved. Moreover, the first shielding case 150 further has openings CR3, CR4 located at two sides thereof, and pore channels CR1, CR2 are formed after the third part 113 and the fourth part 114 are bonded. In this way, after the first shielding case 150 sleeves the third part 113 and the fourth part 114, the opening CR4 corresponds to the pore channel CR2, and the opening CR3 corresponds to the pore channel CR1, such that the first shielding case 150, the third part 113 and the fourth part 114 form lock holes located at two opposite sides to facilitate the electrical adaptor 100 to be assembled with an external device through the lock holes when the cable connector 10 is butted to the external device through the electrical adaptor 100.

On the other hand, the electrical adaptor 100 of the cable connector 10 further includes a second shielding case 140, and the second shielding case 140 sleeves a part of the third part 113, a part of the fourth part 114, and a part of the shielding plate 130 to wrap the second part 112 and the first contact segments S3, S6, and the second shielding case 140 is located within the first shielding case 150 and is electrically connected to the first shielding case 150. In detail, the second shielding case 140 sleeves the third part 113, the tongue structures 113*d*, 131, 114*d* of the shielding plate 130 and the fourth part 114, and the second part 112, so as to provide the shielding effect to the first contact segments S3, S6 of the first terminals 120. Meanwhile, the first shielding case 150 further has elastic arms 152 for structurally leaning against and electrically connecting the second shielding case 140, such that the shielding plate 130, the first shielding case 150 and the second shielding case 140 form a common grounding state.

Referring to FIG. 1A to FIG. 1D, in the embodiment, the third part 113 of the first base 110 further has first buckling portions 113*c*, and the second base 210 has second buckling portions 214 and third buckling portions 212. The second base 210 is buckled to the third part 113 through a buckling effect of the second buckling portions 214 and the first buckling portions 113*c*, and the second base 210 is buckled to the first shielding case 150 through a buckling effect of the third buckling portions 212 and the sidewalls of the first shielding case 150, such that the second base 210 may have an enough bonding strength with the first base 110 and the first shielding case 150. Moreover, the first part 111 of the first base 110 further has guide ribs 111*c*, and the second base 210 further has guide slots 216, such that the second base 210 may be smoothly butted with the first base 110 to avoid miss-insertion.

Figure 3:
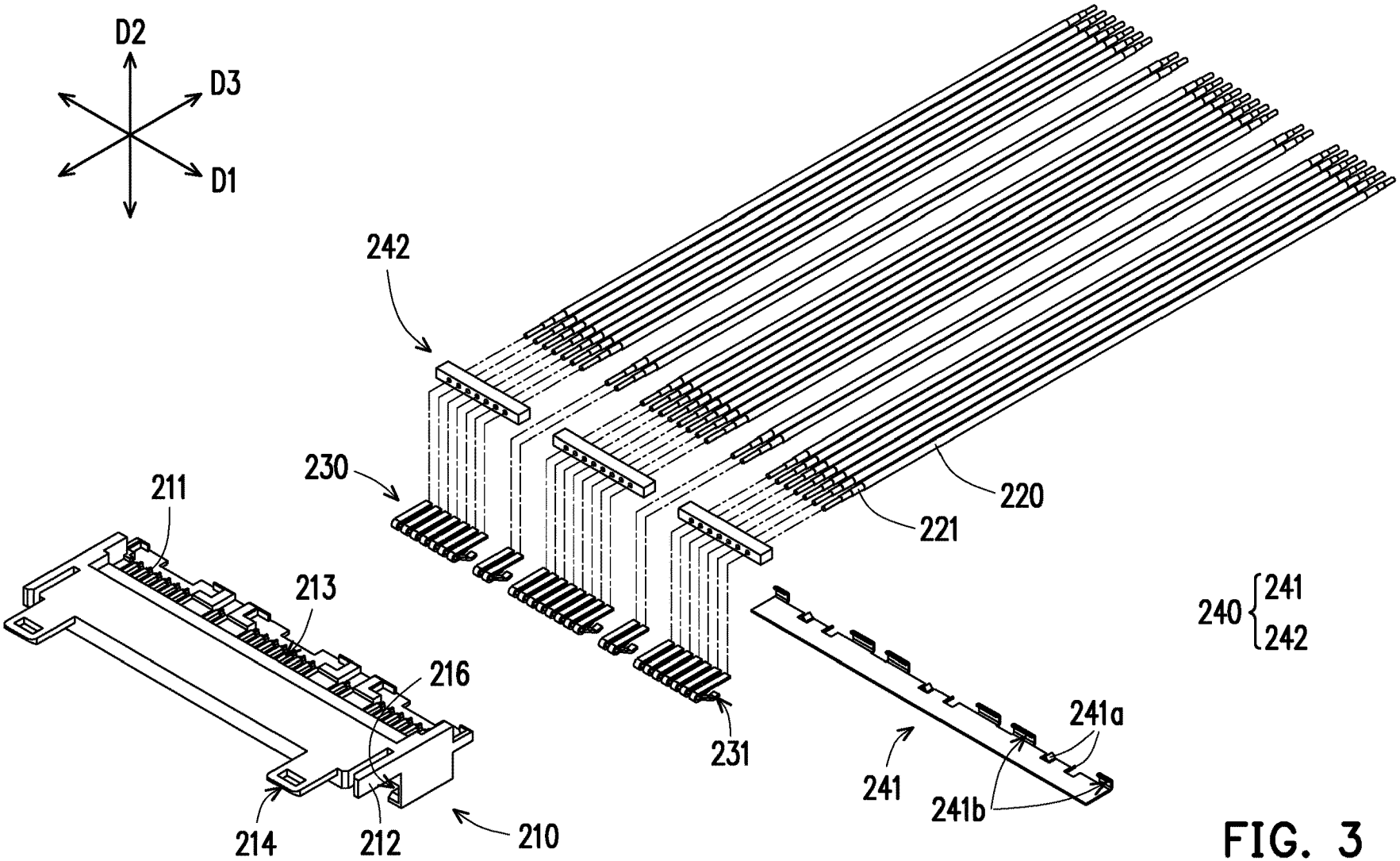
FIG. 3 is an exploded view of a cable connector.

FIG. 3 is an exploded view of the cable connector. Referring to FIG. 3, as described above, the other ends of the second terminals 230 away from the second contact segments 231 are substantially disposed on an extending portion 213 of the second base 210, and the second base 210 further has a plurality of spacers 211 located on the extending portion 213 to space the second terminals 230 and guide the cables 220. Namely, besides that the second contact segments 231 penetrate out from a lower surface of the second base 210, the other ends of the second terminals 230 extend on an upper surface of the second base 210 and are exposed out, such that a conductive layer of each of the cables 220 is electrically connected to the corresponding second terminals 230 through a soldering manner. It should be noted that in the embodiment, the cable assembly 200 further includes a grounding structure 240 disposed on the second base 210, where the grounding structure 240 is electrically connected to grounding layers 221 of the cables 220 and grounding terminals in the second terminals 230. As shown in FIG. 3 of the embodiment, the grounding terminals are located to the leftmost and rightmost, and right correspond to the guide slots 111*a* of the referential numbers C1, C26. Namely, according to a terminal layout of the embodiment, the grounding terminals in the second terminals 230 are structurally leaned against the third terminals 132 for electrical connection. In this way, through the grounding structure 240, the grounding layers 221 of the cables 220 may be commonly grounded, and are further butted with the second terminals 230 (the grounding terminals therein) and the third terminals 132, such that the grounding layers 221 of the cables 220, the second terminals 230 (the grounding terminals therein), the shielding plate 130, the first shielding case 150 and the second shielding case 140 are electrically connected to form a grounding loop.

In detail, the grounding structure 240 includes a plurality of grounding bars 242, and a part of the cables 220 penetrates through the grounding bars 242 such that the grounding layers 221 of the cables 220 are commonly grounded through the grounding bars. Moreover, the grounding structure 240 includes a grounding sheet 241 disposed on the extending portion 213 of the second base 210. The cables 220 penetrating through the grounding bars 242 lean against the grounding sheet 241 through the grounding bars 242, such that the grounding layers 221 of the cables 220, the grounding bars 242 and the grounding sheet 241 are electrically connected and commonly grounded. Further, referring to FIG. 3, FIG. 4A to FIG. 4C, the grounding sheet 241 has contact portions 241*a* and 241*b*, where the grounding sheet 241 is disposed on a lower surface of the extending portion 213, and when the grounding sheet 241 is buckled to the grounding bars 242 through the contact portion 241*b*, the contact portions 241*a* are deformably leaned against lower surfaces of the grounding bars 242. In other words, the grounding bars 242 of the grounding structure 240 electrically connect the grounding layers 221 of the specific cables 220, and although other cables are spaced there between, the grounding bars 242 may still be electrically connected to each other and commonly grounded through the grounding sheet 241.

In other embodiments that are not illustrated, the grounding structure may be changed to an integral structure, i.e. while the grounding layers of the cables are electrically connected, jumper structures are adopted to serially connect the grounding bars.

In summary, in the aforementioned embodiments of the invention, the cable connector is composed of a cable assembly and an electrical adaptor that are detachable from each other, so that besides a performance of a connector is maintained, disassembling and replacing procedures are easy to be implemented. Namely, during a rework process of the detachable structure, the electrical adaptor having a higher chance of abrasion (loss) may be easily disassembled for replacement, and the user is unnecessary to destructively disassemble the whole structure, so that a labor-cost, a time cost and a material cost of the rework process are saved, which avails improving applicability of the cable connector.

Moreover, in the electrical adaptor, besides that the shielding plate, the first shielding case and the second shielding case provide the shielding effect to the first terminals in signal transmission, through structure collocation, the shielding plate, the first shielding case and the second shielding case may be electrically connected and commonly grounded. Comparatively, the cable assembly adopts the grounding structure to commonly ground the grounding layers of the cables. When the cable assembly and the electrical adaptor are butted with each other, the grounding structure is butted with the third terminals of the shielding plate through the grounding terminals of the second terminals, such that the grounding layers of the cables, the second terminals (the grounding terminals therein), the shielding plate, the first shielding case and the second shielding case are electrically connected with each other to form a grounding loop to achieve an effect of multi-grounding point.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A cable connector, comprising:

a first base;

a plurality of first terminals, respectively disposed in the first base, and each of the first terminals having a first tail segment exposed out of the first base;

a second base;

a plurality of second terminals, respectively disposed in the second base, and each of the second terminals having a second contact segment exposed out of the second base; and a plurality of cables, electrically connected to the second terminals correspondingly, wherein the first base and the second base are detachably assembled with each other, and the first tail segments are respectively and detachably connected to at least a part of the second contact segments, such that the first terminals are electrically connected to the second terminals correspondingly, and the cable connector is electrically connected to an external device through a plurality of first contact segments of the first terminals, wherein the first tail segments and the first contact segments are two opposite ends of the first terminals, wherein the first tail segments and the first contact segments are respectively arranged along a first axis, and an arrangement length of the first tail segments along the first axis is greater than an arrangement length of the first contact segments along the first axis.

2. The cable connector as claimed in claim 1, wherein the first base has a plurality of guide slots, the first terminals are disposed in the guide slots, and the second contact segments are respectively guided by the guide slots to structurally contact the first tail segments.

3. The cable connector as claimed in claim 1, wherein one of the first tail segments and the second contact segments are elastic structures.

4. The cable connector as claimed in claim 1, wherein the first tail segments are located in a same plane.

5. The cable connector as claimed in claim 1, wherein the first contact segments are disposed at two opposite sides of the first base along a second axis, and belong to two planes different to and parallel with each other, wherein the second axis is orthogonal to the first axis.

6. The cable connector as claimed in claim 1, wherein the first base and the second base are adapted to be butted with or disassembled from each other along a third axis, and the first contact segments are adapted to be butted with or disassembled from the external device along the third axis, wherein the third axis is orthogonal to the first axis.

7. The cable connector as claimed in claim 1, further comprising:

a grounding structure, disposed in the second base, and electrically connecting grounding layers of the cables and at least one grounding terminal of the second terminals; and a shielding plate, disposed in the first base, and having at least one third terminal exposed out of the first base, wherein when the first base is assembled to the second base, the at least one third terminal structurally contacts the at least one grounding terminal of the second terminals, such that the grounding layers of the cables, the at least one grounding terminal of the second terminals and the shielding plate form a grounding loop.

8. The cable connector as claimed in claim 7, wherein the first base comprises a first part and a second part, the first part, the shielding plate and the third terminals are an integral structure, the first part has a plurality of guide slots accommodating the first tail segments, the second contact segments and the at least one third terminal, the first part is bonded to the outside of the shielding plate, and the first contact segments are respectively located at two opposite surfaces of the shielding plate.

9. The cable connector as claimed in claim 8, wherein the first base further comprises a third part and a fourth part, the third part is assembled to the fourth part to clamp the shielding plate therebetween, and the first part is exposed out of the third part and the fourth part.

10. The cable connector as claimed in claim 9, further comprising:

a first shielding case, sleeving and wrapping the second part, the third part and the fourth part of the first base, wherein the shielding plate has a side wing exposed out of the third part and the fourth part of the first base, and the first shielding case structurally leans against the side wing to electrically connect the shielding plate.

11. The cable connector as claimed in claim 10, wherein the third part, the fourth part and the first shielding case form a lock hole, and the cable connector is assembled to the external device through the lock hole.

12. The cable connector as claimed in claim 10, further comprising:

a second shield case, sleeving a portion of the third part, a portion of the fourth part and a portion of the shielding plate to wrap the second part and the first contact segments, wherein the second shielding case is located within the first shielding case and electrically connected to the first shielding case.

13. The cable connector as claimed in claim 10, wherein the third part has a first buckling portion, and the second base has a second buckling portion and a third buckling portion, and the second base is buckled to the third part through a buckling effect of the second buckling portion and the first buckling portions, and the second base is buckled to the first shielding case through a buckling effect of the third buckling portion and a sidewall of the first shielding case.

14. The cable connector as claimed in claim 7, wherein a sum of an amount of the first terminals and an amount of the at least one third terminal is equal to an amount of the second terminals.

15. The cable connector as claimed in claim 7, wherein the grounding structure comprises a plurality of grounding bars, and a part of the cables penetrates through the grounding bars to commonly ground the grounding layers through the grounding bars.

16. The cable connector as claimed in claim 15, wherein the grounding structure further comprises a grounding sheet disposed on an extending portion of the second base, wherein the cables penetrating through the grounding bars lean against the grounding sheet through the grounding bars, so as to commonly ground the grounding layers of the cables, the grounding bars and the grounding sheet.

17. The cable connector as claimed in claim 16, wherein the grounding sheet has a contact portion, and the grounding sheet is bonded to a lower surface of the extending portion, and the contact portion extends from the grounding sheet and is deformably leaned against the grounding bars.

18. The cable connector as claimed in claim 16, wherein the second base further has a plurality of spacers located on the extending portion to space the second terminals and guide the cables.

19. The cable connector as claimed in claim 1, wherein one end of each of the second terminals penetrates out from a lower surface of the second base, and another end of each of the second terminals extends on an upper surface of the second base and is exposed out, and a conductive layer of each of the cables is electrically connected to the another end of each of the second terminals.

20. An electrical adaptor, comprising:

a first base; and a plurality of first terminals, disposed in the first base, wherein the electrical adaptor is detachably butted with a second base and a plurality of second terminals of a cable assembly through the first base and the first terminals, such that a first tail segment of each of the first terminals is detachably leaned against a second contact segment of each of the second terminals, the first tail segments are disposed in a plurality of guide slots on the first substrate and are located in a same plane, and each of the first terminals further has a first contact segment opposite to the first tail segment, and the first contact segments respectively belong to two planes different to and parallel with each other, wherein the cable assembly is electrically connected to an external device through the first contact segments of the electrical adaptor.

21. The electrical adaptor as claimed in claim 20, wherein the first tail segments and the first contact segments are respectively arranged along a first axis, and an arrangement length of the first tail segments along the first axis is greater than an arrangement length of the first contact segments along the first axis.

22. The electrical adaptor as claimed in claim 20, wherein one of the two planes where the first contact segments belong to is coplanar with the first tail segments.

23. The electrical adaptor as claimed in claim 20, wherein the first base comprises a first part and a second part, the first part has the guide slots, and the first contact segments are located at the second part.

24. The electrical adaptor as claimed in claim 23, further comprising:

a shielding plate, assembled to the second part, and having at least one third terminal disposed in at least one guide slot of the first part and located in a same plane with the first tail segments.

25. The electrical adaptor as claimed in claim 24, wherein the shielding plate, the first terminals and the first part are an integral structure.

26. The electrical adaptor as claimed in claim 24, wherein the at least one third terminal is located at a first position or a last position relative to the first tail segments.

27. The electrical adaptor as claimed in claim 24, wherein the shielding plate has a pair of third terminals, and the first tail segments are located between the pair of third terminals.

28. The electrical adaptor as claimed in claim 24, wherein the first base further comprises a third part and a fourth part, the third part is assembled to the fourth part to clamp the shielding plate therebetween, and the first part is exposed out of the third part and the fourth part.

29. The electrical adaptor as claimed in claim 28, wherein the third part, the shielding plate and the fourth part respectively have a tongue structure, the second part sleeves the tongue structures, and the tongue structure of the shielding plate and the first contact segments are spaced by the tongue structure of the third part and the tongue structure of the fourth part.

30. The electrical adaptor as claimed in claim 29, further comprising:

a first shielding case, sleeving and wrapping the second part, the third part and the fourth part, wherein the shielding plate has a side wing exposed out of the third part and the fourth part and electrically connecting the first shielding case.

31. The electrical adaptor as claimed in claim 30, wherein the first shielding case, the third part and the fourth part form a lock hole, and the electrical adaptor is assembled to the external device through the lock hole.

32. The electrical adaptor as claimed in claim 30, further comprising:

a second shielding case, sleeving the tongue structures to wrap the first contact segments, wherein the second shielding case is located within the first shielding case and electrically connected to the first shielding case.

* * * * *